US006886551B2

(12) United States Patent
Scherer et al.

(10) Patent No.: US 6,886,551 B2
(45) Date of Patent: May 3, 2005

(54) BLOCK SPLITTING ASSEMBLY AND METHOD

(75) Inventors: Ronald J. Scherer, Shakopee, MN (US); Paul W. Bailey, Mora, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/411,453

(22) Filed: Apr. 10, 2003

(65) Prior Publication Data

US 2004/0200468 A1 Oct. 14, 2004

(51) Int. Cl.[7] ..... B28D 1/32

(52) U.S. Cl. ..... 125/23.01

(58) Field of Search ..... 125/23.01, 40

(56) References Cited

U.S. PATENT DOCUMENTS

| | | | | |
|---|---|---|---|---|
| 806,951 | A | 12/1905 | Bryning | |
| 863,851 | A | 8/1907 | Jones | |
| 1,375,777 | A | 4/1921 | Chase | |
| 1,534,353 | A | 4/1925 | Besser | |
| 1,893,430 | A | 1/1933 | McKenzie | |
| 2,319,154 | A | 5/1943 | Orlow | |
| 2,420,790 | A | 5/1947 | Moeller | |
| 2,431,469 | A | 11/1947 | Eyles | |
| 2,460,386 | A | 2/1949 | Hillquist | |
| 2,486,765 | A | 11/1949 | Snyder | |
| 2,557,251 | A | 6/1951 | Baker et al. | |
| 2,593,606 | A | 4/1952 | Price | |
| 2,657,681 | A * | 11/1953 | Gatzke | 125/23.01 |
| 2,723,657 | A | 11/1955 | Jones | |
| 2,746,447 | A | 5/1956 | Petch | |
| 2,755,790 | A | 7/1956 | Graham | |
| 2,775,236 | A | 12/1956 | Blum | |
| 2,779,324 | A * | 1/1957 | Schlough et al. | 125/23.01 |
| 2,798,475 | A | 7/1957 | Van Hoose | |
| 2,810,946 | A * | 10/1957 | Garnich | 425/308 |
| 2,867,205 | A * | 1/1959 | Vesper | 125/23.01 |
| 2,874,688 | A * | 2/1959 | Biesanz, Sr. et al. | 125/23.01 |
| 2,881,753 | A | 4/1959 | Entz | |

(Continued)

FOREIGN PATENT DOCUMENTS

| | | |
|---|---|---|
| DE | 44 31 850 A1 | 3/1996 |
| EP | 0 294 267 A1 | 12/1988 |
| GB | 1 245 921 | 9/1971 |
| GB | 1 509 747 | 5/1978 |

OTHER PUBLICATIONS

"Besser Integrated Splitter and Turnover," Besser Company, 4 pages (Date Unknown).

Copy of U.S. Appl. No. 09/691,864, entitled "Block Splitting Assembly and Method," filed Oct. 19, 2000.

Copy of U.S. Appl. No. 09/884,795, entitled "Block Splitting Assembly and Method," filed Jun. 19, 2001.

Copy of U.S. Appl. No. 10/103,155, entitled "Block Splitting Assembly and Method," filed Mar. 20, 2002.

"Fairlane Positioning and Workholding Products," http: www.fairlaneprod.com.index.htm, Fairlane Products Inc., 2 pages (Date Printed Nov. 15, 2001).

4 Photos of a Besser Lithibar Splitter & Turnover dated Oct. 3, 2001.

1 Photo of a hold–down mechanism used on a Besser Lithibar Splitter & Turnover, dated Sep. 11, 2002.

*Primary Examiner*—M. Rachuba
(74) *Attorney, Agent, or Firm*—Merchant & Gould P.C.

(57) ABSTRACT

The invention relates to equipment and related methods for producing concrete retaining wall blocks. The equipment and methods described herein can be used to enhance the effectiveness of splitting assemblies that utilize workpiece engaging members disposed to at least one side of a splitting line and which engage the workpiece as it is split into at least two pieces.

56 Claims, 7 Drawing Sheets

U.S. PATENT DOCUMENTS 2,889,823 A * 6/1959 Rickard ..... 125/23.01
2,925,080 A 2/1960 Smith
2,974,661 A * 3/1961 Mayer ..... 125/23.01
3,060,917 A 10/1962 Dickey
3,095,868 A 7/1963 Mangis
3,120,842 A 2/1964 Cox et al.
3,141,453 A 7/1964 Dickey
3,265,056 A 8/1966 Pieper et al.
3,392,719 A 7/1968 Clanton et al.
3,424,144 A * 1/1969 Giconi ..... 125/23.01
3,439,664 A 4/1969 Sylvester
3,492,984 A 2/1970 Harper
3,559,631 A 2/1971 Mangis
3,664,320 A 5/1972 Allen et al.
3,677,258 A 7/1972 Fletcher et al.
3,792,635 A 2/1974 Göransson
3,809,049 A 5/1974 Fletcher et al.
3,815,570 A 6/1974 Story
3,840,000 A 10/1974 Bible
3,844,269 A 10/1974 Rater
3,978,842 A 9/1976 Coffman
4,068,648 A 1/1978 Erdman
4,111,180 A 9/1978 Goodrich
4,184,472 A 1/1980 Benedicto et al.
4,250,863 A 2/1981 Gagnon et al.
4,294,443 A 10/1981 Sova
4,335,549 A 6/1982 Dean, Jr.
4,346,691 A 8/1982 Bourke
5,066,070 A 11/1991 Clarke
5,085,008 A 2/1992 Jennings et al.
5,152,275 A 10/1992 Landhuis
5,413,086 A 5/1995 Trudeau
5,662,094 A 9/1997 Giacomelli
5,722,386 A 3/1998 Fladgard et al.
5,758,634 A 6/1998 Ellison, Jr.
6,050,255 A 4/2000 Sievert
6,102,026 A * 8/2000 Fladgard et al. ..... 125/23.01
6,321,740 B1 * 11/2001 Scherer et al. ..... 125/40
D464,145 S 10/2002 Scherer et al.
2002/0015620 A1 2/2002 Woolford et al.
2003/0089363 A1 5/2003 Suto et al.

* cited by examiner

BLOCK SPLITTING ASSEMBLY AND METHOD

FIELD OF THE INVENTION

The invention relates generally to the manufacture of concrete blocks. More specifically, it relates to equipment and processes for the creation of decorative faces on concrete blocks. Even more specifically, the invention relates to equipment and processes for producing irregular textures and the appearance of weathered or rock-like edges on concrete blocks, as well as to concrete blocks that result from such equipment and processes.

BACKGROUND OF THE INVENTION

It has become common to use concrete blocks for landscaping purposes. Such blocks are used to create, for example, retaining walls, ranging from small tree ring walls and garden edging walls to comparatively large structures. Concrete blocks are made in high speed production plants, and typically are exceedingly uniform in appearance. This is not an undesirable characteristic in some landscaping applications, but it is a drawback in many applications where there is a demand for a "natural" appearance to the material used to construct the walls and other landscaping structures.

One way to make concrete blocks less uniform, and more "natural" appearing, is to use a splitting process to create a "rock-face" on the block. In this process, as it is commonly practiced, a large concrete workpiece which has been adequately cured is split or cracked apart to form two blocks. The resulting blocks have faces along the plane of splitting or cleaving that are textured and irregular. This process of splitting a workpiece into two concrete blocks to create a rock-like appearance on the exposed faces of the blocks is shown, for example, in Besser's U.S. Pat. No. 1,534,353, which discloses the manual splitting of blocks using a hammer and chisel.

Automated equipment to split a concrete workpiece to form blocks is well-known, and generally includes a splitting apparatus comprising a supporting table and opposed, hydraulically-actuated splitting blades. A splitting blade in this application is typically a substantial steel plate that is tapered to a relatively narrow or sharp knife edge. The blades typically are arranged so that the knife edges will engage the top and bottom surfaces of the workpiece perpendicular to those surfaces, and arranged in a coplanar relationship with each other. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits (cleaves), generally along the plane of alignment of the blades.

These machines are useful for the high-speed processing of blocks. They produce an irregular, rock-face finish on the blocks. No two faces resulting from this process are identical, so the blocks are more natural in appearance than standard, non-split blocks. However, the edges of the faces resulting from the industry-standard splitting process are generally well-defined, i.e., regular and "sharp". These concrete blocks can be made to look more natural if the regular, sharp edges of their faces are eliminated.

One known process for eliminating the regular, sharp edges on concrete blocks is the process known as tumbling. In this process, a relatively large number of blocks are loaded into a drum which is rotated around a generally horizontal axis. The blocks bang against each other, knocking off the sharp edges, and also chipping and scarring the edges and faces of the blocks. The process has been commonly used to produce a weathered, "used" look to concrete paving stones. These paving stones are typically relatively small blocks of concrete. A common size is 3.75 inches wide by 7.75 inches long by 2.5 inches thick, with a weight of about 6 pounds.

The tumbling process is also now being used with some retaining wall blocks to produce a weathered, less uniform look to the faces of the blocks. There are several drawbacks to the use of the tumbling process in general, and to the tumbling of retaining wall blocks, in particular. In general, tumbling is a costly process. The blocks must be very strong before they can be tumbled. Typically, the blocks must sit for several weeks after they have been formed to gain adequate strength. This means they must be assembled into cubes, typically on wooden pallets, and transported away from the production line for the necessary storage time. They must then be transported to the tumbler, depalletized, processed through the tumbler, and recubed and repalletized. All of this "off-line" processing is expensive. Additionally, there can be substantial spoilage of blocks that break apart in the tumbler. The tumbling apparatus itself can be quite expensive, and a high maintenance item.

Retaining wall blocks, unlike pavers, can have relatively complex shapes. They are stacked into courses in use, with each course setback a uniform distance from the course below. Retaining walls must also typically have some shear strength between courses, to resist the pressure of the soil behind the wall. A common way to provide uniform setback and course-to-course shear strength is to form an integral locator and shear protrusion on the blocks. Commonly these protrusions take the form of lips (or flanges) or tongue and groove structures. Because retaining wall blocks range in size from quite small blocks having a front face with an area of about 0.25 square feet and weighing about 10 pounds, up to quite large blocks having a front face of a full square foot and weighing on the order of one hundred pounds, they may also be cored, or have extended tail sections. These complex shapes cannot survive the tumbling process. Integral protrusions get knocked off, and face shells get cracked through. As a consequence, the retaining wall blocks that do get tumbled are typically of very simple shapes, are relatively small, and do not have integral protrusions. Instead, they must be used with ancillary pins, clips, or other devices to establish setback and shear resistance. Use of these ancillary pins or clips makes it more difficult and expensive to construct walls than is the case with blocks having integral protrusions.

Another option for eliminating the sharp, regular edges and for creating an irregular face on a concrete block is to use a hammermill-type machine. In this type of machine, rotating hammers or other tools attack the face of the block to chip away pieces of it. These types of machines are typically expensive, and require space on the production line that is often not available in block plants, especially older plants. This option can also slow down production if it is done "in line", because the process can only move as fast as the hammermill can operate on each block, and the blocks typically need to be manipulated, e.g. flipped over and/or rotated, to attack all of their edges. If the hammermill-type process is done off-line, it creates many of the inefficiencies described above with respect to tumbling.

Yet another option for creating a more natural block face appearance and eliminating the sharp, regular edges of concrete blocks is disclosed in commonly assigned, copending U.S. patent application Ser. Nos. 09/884,795 (filed Jun. 19, 2001), 09/691,864 (filed Oct. 19, 2000), and 10/103,155 (filed Mar. 20, 2002), and in U.S. Pat. No. 6,321,740, which are incorporated herein by reference in their entirety. As disclosed in these copending applications and patent, a splitting assembly is provided with a plurality of projections that are disposed on at least one side of a splitting line with which a workpiece to be split by the splitting assembly is aligned. The projections are positioned to engage the workpiece during splitting to create an irregular front surface and an irregular upper and/or lower front edge on the resulting block. As is further disclosed, the projections can be disposed on each side of the splitting line, and projections can be provided on a single splitting assembly, or on each splitting assembly of an opposed pair of splitting assemblies.

It has been discovered that when splitting concrete workpieces to form two concrete blocks using splitting assemblies of the type disclosed in U.S. patent application Ser. Nos. 09/884,795 (filed Jun. 19, 2001), 09/691,864 (filed Oct. 19, 2000), and 10/103,155 (filed Mar. 20, 2002), and in U.S. Pat. No. 6,321,740, the to-be-formed blocks may have a tendency move during splitting as a result of contact with the splitting assemblies. The movement includes movement of the to-be-formed blocks away from each other, and lifting of the rear ends of the to-be-formed blocks. This tendency toward movement increases as the weight of the to-be-formed blocks decreases, due to the fact that the blocks have less mass that would tend to prevent such movement. If the movement during splitting is great enough, the projections of the splitting assembly will not create the desired degree of irregularity of the front surface and the upper and/or lower front edge.

SUMMARY OF THE INVENTION

The invention relates to equipment and related methods for producing concrete retaining wall blocks. The equipment and methods described herein can be used to enhance the effectiveness of splitting assemblies of the type disclosed in U.S. patent application Ser. Nos. 09/884,795 (filed Jun. 19, 2001), 09/691,864 (filed Oct. 19, 2000), and 10/103,155 (filed Mar. 20, 2002), and in U.S. Pat. No. 6,321,740, and of similar splitting assemblies, when used to split concrete workpieces to form concrete blocks.

In accordance with a first aspect of the invention, a method of producing a concrete block is provided. The method comprises providing a concrete block splitting machine having a splitting line with which a concrete workpiece to be split is aligned; the block splitting machine including a first splitting assembly that is engageable with the workpiece for splitting the workpiece into at least two pieces. The first splitting assembly includes a plurality of projections disposed on at least one side of the splitting line and positioned so that they engage the workpiece as it is split into the at least two pieces to create an irregular front surface and an irregular top or bottom edge on at least one of the split pieces. A concrete workpiece is located in the concrete block splitting machine so that a cleaving line of the workpiece is aligned with the splitting line. Thereafter, a downward biasing force is applied to the workpiece and the workpiece is split into at least two pieces using the first splitting assembly while the biasing force is being applied to the workpiece, wherein at least one of the split pieces is the concrete block. It is preferred that the biasing force be sufficient to hold the workpiece substantially stationary during splitting.

In another aspect of the invention, a method of producing a concrete block is provided. The method comprises providing a concrete block splitting machine having a first splitting assembly that is engageable with the workpiece for splitting the workpiece into at least two pieces; the first splitting assembly including a first block splitter and a plurality of projections disposed adjacent to at least one side of the first block splitter and positioned so that they engage the workpiece as it is split into the at least two pieces to create an irregular surface and an irregular top or bottom edge on at least one of the split pieces. A concrete workpiece is located in the concrete block splitting machine in a position to be split. Thereafter, a downward biasing force is applied to the workpiece and the workpiece is split into at least two pieces using the first splitting assembly while the biasing force is being applied to the workpiece, wherein at least one of the split pieces is the concrete block. Again, it is preferred that the biasing force be sufficient to hold the workpiece substantially stationary during splitting.

In yet another aspect of the invention, a block splitting machine for splitting a concrete workpiece into at least two pieces is provided. The block splitting machine comprises a splitting line with which a cleaving line of a workpiece to be split is aligned. A first splitting assembly is actuatable into engagement with the workpiece for splitting the workpiece into the at least two pieces, with the first splitting assembly including a plurality of projections disposed on at least one side of the splitting line and positioned so that they engage the workpiece as it is split into the at least two pieces to create an irregular surface and an irregular top or bottom edge on at least one of the split pieces. In addition, the block splitting machine includes a first mechanism for applying a downward biasing force to the workpiece as the first splitting assembly engages the workpiece during splitting. It is preferred that the biasing force be sufficient to hold the workpiece substantially stationary during splitting.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENTS

The invention relates to the splitting of concrete workpieces to create a more natural appearance to the faces of concrete blocks that result from splitting the workpieces. The concrete blocks can be, for example, concrete retaining wall blocks, architectural concrete blocks for use in building construction, and other concrete blocks.

Equipment and processes that create a more natural appearing block face and which eliminate the regular, sharp face edges are disclosed in commonly assigned, copending U.S. patent application Ser. Nos. 09/884,795, 09/691,864, and 10/103,155, and in U.S. Pat. No. 6,321,740, which are incorporated herein by reference in their entirety. As disclosed in these documents, top and bottom splitting assemblies are positioned opposite each other on opposite sides of a concrete workpiece that is to be split by the splitting assemblies. Each splitting assembly is provided with a plurality of workpiece engaging members in the form of projections that are disposed on at least one side of a splitting line with which the workpiece is aligned. The projections are positioned to engage the workpiece during splitting to contribute to the creation of an irregular front surface and an irregular upper and lower front edge on the resulting block. A typical workpiece that is split is formed by two blocks molded from no-slump concrete in a face-to-face arrangement so that splitting of the workpiece creates irregular front faces on both blocks.

It has been discovered that during operation of the splitting assemblies disclosed in these copending applications and issued patent, contact between the splitting assemblies and some workpieces can cause the to-be-formed blocks to move during the splitting process. For example, the top splitting assembly is typically actuated to contact the workpiece before the bottom splitting assembly. As a result, when the top splitting assembly makes contact with the top of the workpiece, the rear of each of the to-be-formed blocks have a tendency to lift or rotate upwardly. In addition, contact with the splitting assemblies tends to force the to-be-formed blocks away from each other. This tendency for movement increases as the weight of the to-be-formed blocks decreases, due to the fact that the blocks have less mass that would tend to prevent such movement.

Movement of the to-be-formed blocks during splitting can reduce the desired effect of the splitting assemblies, including the projections, due to the fact that the projections are configured, positioned, and oriented based on the assumption that the to-be-formed blocks do not move during splitting. Therefore, movement during splitting can prevent the projections from contacting the to-be-formed blocks at the expected positions and angles, thereby reducing the effect of the projections and impacting the resulting appearance of the blocks.

Figure 1:
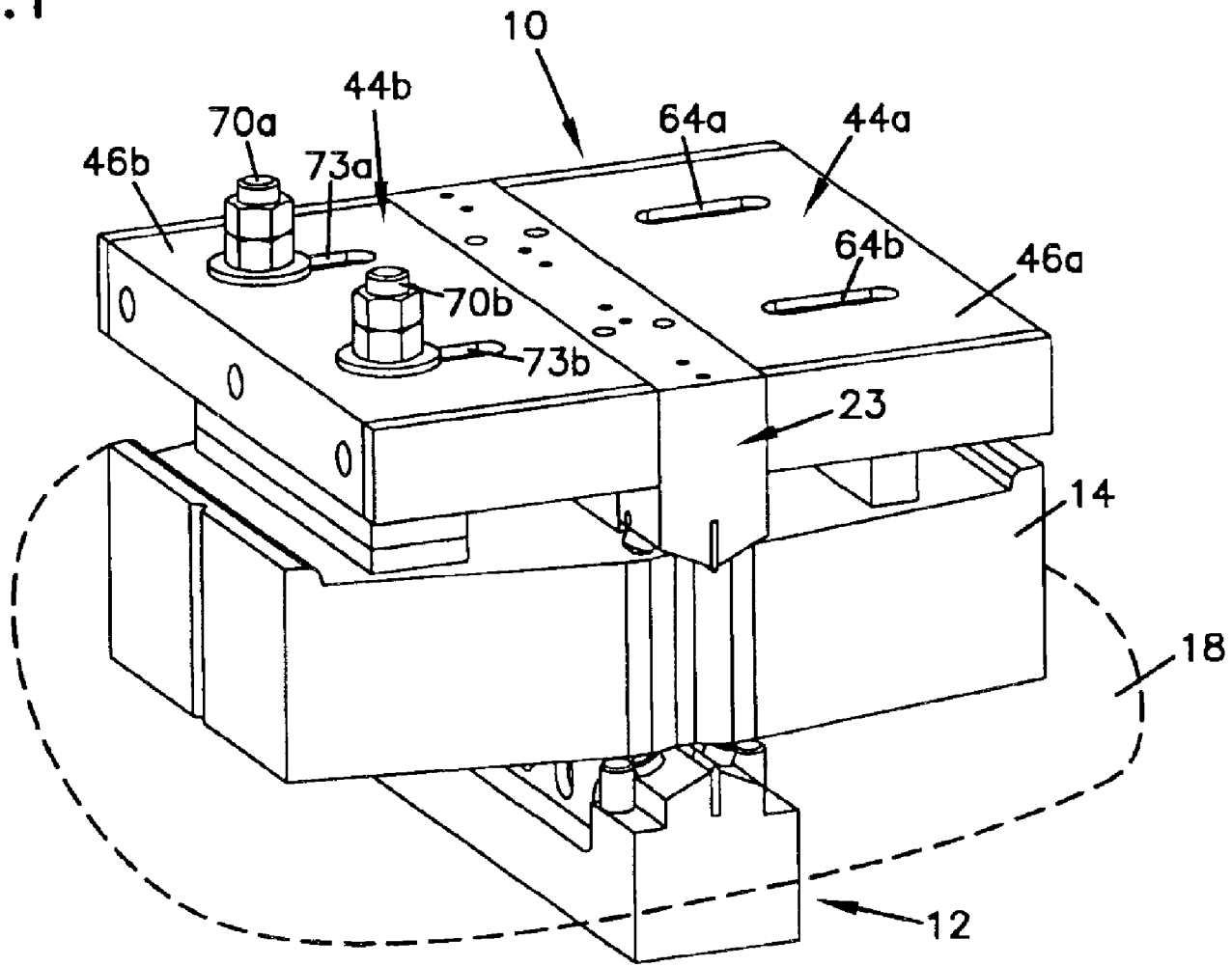
FIG. 1 is a partial perspective view of a splitting area of a block splitting machine using block splitting assemblies of the invention.

Attention is now directed to the figures where like parts are identified with like numerals. FIG. 1 illustrates top and bottom splitting assemblies 10, 12 in accordance with the present invention positioned relative to an adequately cured workpiece 14 that is to be split into two pieces. It is preferred that the split pieces each be a concrete block, and the invention will be hereinafter described with respect to the production of two concrete blocks. However, one split piece could be a concrete block while the other split piece is a waste piece. In addition, the concepts disclosed herein could be used to split a workpiece that results in more than two concrete blocks.

The splitting assemblies 10, 12 are utilized in a block splitting machine having a splitting line SL with which a cleaving line of the workpiece to be split is aligned in a ready-to-split position. The splitting line SL is illustrated in dashed lines in FIGS. 3 and 5. The cleaving line of the workpiece 14 is not illustrated but is aligned with the splitting line during splitting. The splitting line SL is typically an imaginary line in the block splitting machine. However, the splitting line SL could be an actual line provided in the block splitting machine to provide a visual reference to users of the machine. In addition, the cleaving line of the workpiece is typically an imaginary line on the workpiece along which it is desired to split the workpiece. The cleaving line could also be defined by a pre-formed splitting groove defined in the top or bottom surface, or both surfaces, of the workpiece 14.

Block splitting machines suitable for utilizing the top and bottom splitting assemblies 10, 12 so as to practice the present invention may be obtained from Besser Company located in Alpena, Mich. and other equipment manufacturers. When referring to the splitting assemblies 10, 12, the terms "bottom", "top", "upper", and "lower" refer to the position of the splitting assemblies relative to the workpiece 14 during splitting. Likewise, when referring to the workpiece 14, the terms "bottom", "top", "upper", and "lower" refer to the particular workpiece surfaces as they are oriented during splitting. The workpiece 14 is preferably oriented "lips up" during splitting. This "lips up" orientation allows the workpiece 14 to lay flat on what will be the upper surfaces of the resulting blocks when the blocks are laid in a wall.

Figure 2:
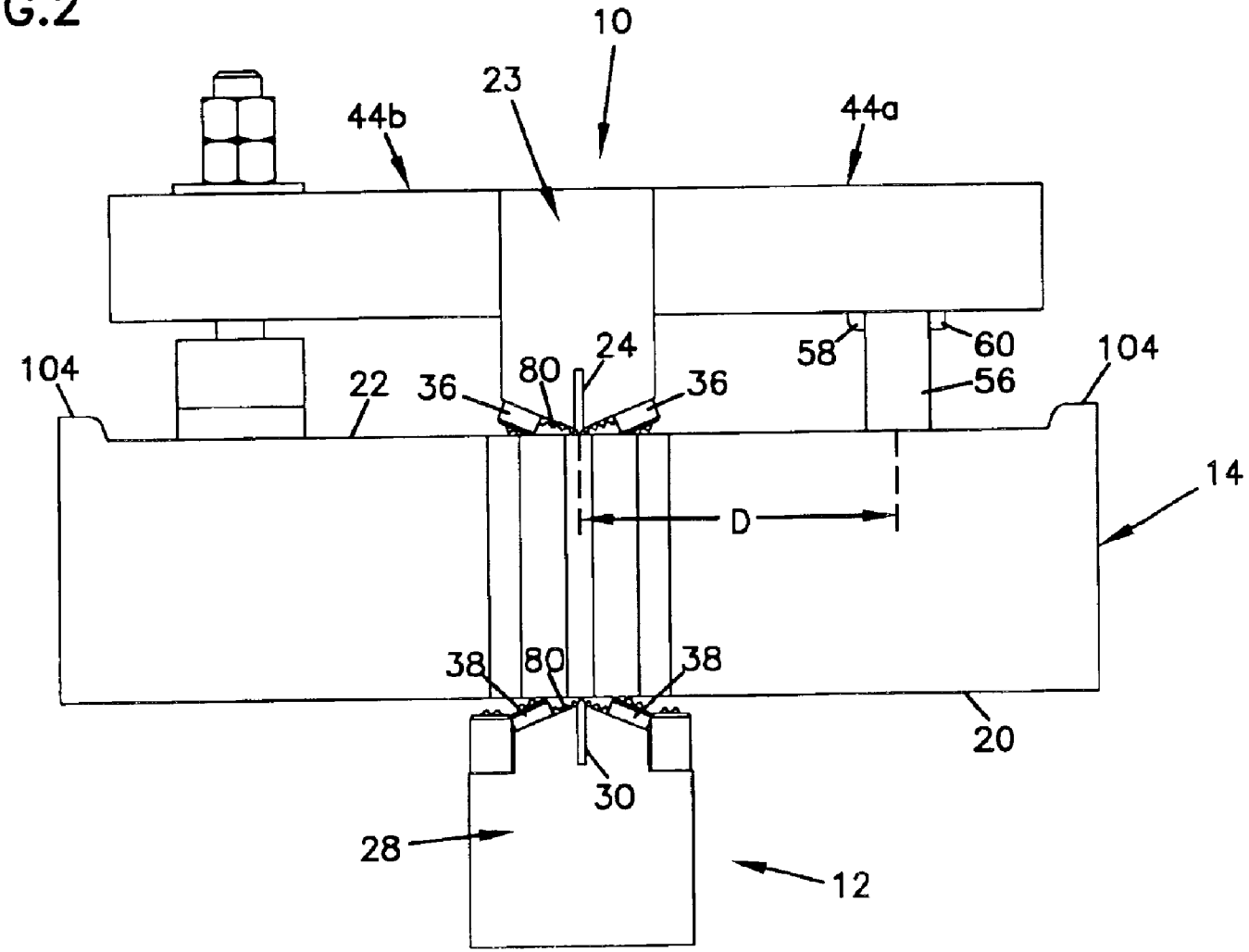
FIG. 2 is a side view of the splitting area of FIG. 1 illustrating the top and bottom splitting assemblies positioned relative to a workpiece.

With reference to FIGS. 1 and 2, the bottom splitting assembly 12 is adapted to move upwardly through an opening in a support table 18 (shown in dashed lines in FIG. 1) of the block splitting machine in a manner known in the art, to engage a bottom surface 20 of the workpiece 14 during the splitting operation, and to move downwardly through the opening back to a home position after completion of the splitting operation so that the blocks can be removed from the splitting machine and one or more subsequent workpieces can be positioned in the splitting machine aligned with the splitting line SL. The support table 18 supports the workpiece 14 during splitting.

As can be further seen in FIGS. 1 and 2, the top splitting assembly 10 is positioned above the workpiece 14, opposite the bottom splitting assembly 12, in order to strike a top surface 22 of the workpiece during a splitting operation. The top splitting assembly 10 is preferably mounted so as to be moveable downward into engagement with the workpiece 14, and to be moveable upward to a home position so that a subsequent workpiece can be positioned for splitting. As discussed above, it is typical for the top splitting assembly 10 to be actuated so as to contact the workpiece 14 before the bottom splitting assembly 12 makes contact. The mechanisms for causing movement of the splitting assemblies 10, 12 are well known to persons having ordinary skill in the art.

With reference to FIGS. 1–4, the top splitting assembly 10 includes a block splitter holder 23 having a block splitter 24 secured thereto, which together form means for splitting the workpiece 14. In the embodiment illustrated, the holder 23 comprises a blade holder, and the block splitter 24 comprises a splitting blade. For sake of convenience, the invention will hereinafter be described by referring to "blade holder 23" or "holder 23" and "splitting blade 24" or "blade 24". However, it is to be realized that the holder 23 and the splitter 24 could be formed by structures other than those illustrated in the figures. Further, the block splitter could also be in the form of projections (described below).

The blade 24 includes a central splitting edge 25. As is evident from FIG. 3, the central splitting edge 25 extends parallel to and defines the splitting line SL along which the workpiece(s) will be split. In the preferred embodiment, the splitting line SL is a straight line, and the resulting split face of each block will be generally planar as a result. However, the splitting line could take on other configurations, such as, for example, curved, if desired, in which case the splitting edge 25 would be curved so as to produce a split face that is curved from side face to side face. In addition, the blade holder 23 includes engagement surfaces 26*a*, 26*b* extending outwardly from the blade 24, as shown in FIG. 4.

Likewise, as seen in FIGS. 1, 2, 5 and 6, the bottom splitting assembly 12 includes a blade holder 28 having a blade 30 that includes a central splitting edge 32. The central splitting edge 32 preferably extends parallel to the splitting edge 25 along the splitting line SL. Further, the blade holder 28 includes engagement surfaces 34*a*, 34*b* extending outwardly from the blade 30.

The engagement surfaces 26*a*, 26*b*, 34*a*, 34*b* extend away from the blades 24, 30, respectively, at relatively shallow angles, so that, during a splitting operation, the surfaces 26*a*, 26*b*, 34*a*, 34*b* will engage the workpiece(s). This engagement breaks the split edges of the resulting blocks in a random fashion. The irregular breaking action can be enhanced by placing projections (discussed further below) on the engagement surfaces 26*a*, 26*b*, 34*a*, 34*b* as desired. Referring to FIG. 4, the engagement surfaces 26*a*, 26*b*, 34*a*, 34*b* are preferably oriented at an angle $\alpha$ between about 5 degrees and about 15 degrees relative to horizontal. Preferably, the angle $\alpha$ is about 15 degrees.

The splitting assemblies 10, 12 also include projections 36, 38 that are designed to contact the workpiece and contribute to the irregular breaking action that occurs. However, it to be realized that projections having forms and shapes other than those illustrated herein could be used.

The projections 36, 38 are provided on surfaces 27*a*, 27*b*, 35*a*, 35*b* of the blade holders 23, 28 disposed on each side of the engagement surfaces 26*a*, 26*b*, 34*a*, 34*b*. As illustrated, the surfaces 27*a*, 27*b*, 35*a*, 35*b* extend away from the blades 24, 30, respectively, at an angle $\beta$ that is different than the angle $\alpha$ of the engagement surfaces 26*a*, 26*b*, 34*a*, 34*b*. In the preferred embodiment, the angle $\beta$ is greater than the angle $\alpha$. An angle $\beta$ of about 22 degrees has been found to produce satisfactory results.

The projections 36, 38 are preferably adjustable and removable. In this way, the same splitting assemblies can be used for splitting different workpiece configurations by changing the number, location, spacing and height of the projections. The projections are preferably threaded into corresponding threaded openings in the surfaces 27*a*, 27*b*, 35*a*, 35*b* for adjustment, although other height adjustment means could be employed. However, during a splitting action, the projections, the blades and the blade holders are in a fixed relationship relative to each other, whereby as the blade holder moves, the projections associated with the blade and blade holder move simultaneously therewith.

The projections 36, 38 in this embodiment are cylindrical and are preferably made of a carbide-tipped metal material. In addition, the top surfaces of the projections 36, 38 are jagged, comprising many pyramids in a checkerboard pattern. Projections such as these can be obtained from Fairlane Products Co. of Fraser, Mich. It will be understood that a variety of other projection top surface configurations could be employed. The height of the top surface of the projections is preferably about 0.040 inches below the splitting edges 25, 32 of the blades 24, 30. However, the projections may extend further below, or some distance above, the top of the blades 24, 30, within the principles of the invention. Projections that are about 0.375 inch in diameter and projections that are about 0.625 inch in diameter have been practiced with satisfactory results. The projections 36, 38 can be about 0.75 inches long from end to end. The loose block material from the splitting process entering the threads of the projections, in combination with the vertical force of the splitting strikes, are considered sufficient to lock the projections in place. However, other mechanisms could be used to lock the projections in place relative to the blades during the splitting process, such as set-screws.

The blades 24, 30 and the projections 36, 38 are wear locations during the splitting process. The removable mounting of the projections 36, 38 permits the projections to be removed and replaced as needed due to such wear. It is also preferred that the blades 24, 30 be removable and replaceable, so that as the blades wear, they can be replaced as needed. The blades 24, 30 can be secured to the respective blade holders 23, 28 through any number of conventional removable fastening techniques, such as by bolting the blades to the blade holders, with each blade being removably disposed within a slot formed in the respective blade holder as shown in FIGS. 1–6. The blades could also be integrally formed with the respective blade holder if desired.

The bottom splitting assembly 12 also includes adjustable and removable projections 40 extending vertically upward from horizontal shoulders 42 formed on the blade holder 28, as shown in FIGS. 1–3, 5 and 6. The projections 40 are similar in construction to the projections 36, 38, although the projections 40 can be larger or smaller in size than the projections 36, 38, depending upon the desired effect to be achieved. The projections 40 can be about 1.5 inches in length.

The angling of the projections 36, 38 on the surfaces 27*a*, 27*b*, 35*a*, 35*b* of the blade holders 23, 28 allows the projections 36, 38 to gouge into the workpiece(s) and break away material primarily adjacent the bottom and top edges of the resulting blocks, however without breaking away too much material. As noted above, the bottom splitting assembly 12 typically contacts the workpiece 14 after the top splitting assembly 10 has begun its splitting action. The initial splitting action of the top splitting assembly 10 can force the resulting split pieces of the workpiece 14 away from each other before the bottom splitting assembly 12 and the angled projections 38 can fully complete their splitting action. However, the vertical projections 40 on the shoulders 42 of the blade holder 28 help to hold the blocks in place to enable the angled projections 38 to complete their splitting action. The vertical projections 40 also break away portions of the blocks adjacent the top edges of the resulting block(s).

In the illustrated embodiment, the projections 36, 38 are arranged so that the central axes thereof extend generally at right angles from the surfaces 27*a*, 27*b*, 35*a*, 35*b*. However, other orientations of the projections are possible. For example, the projections 36, 38 could be oriented so that the central axes thereof extend generally parallel to the projections 40. In addition, the projections 36, 38 could be oriented so that the central axes thereof angle toward the blades 24, 30.

The projections 36, 38, 40 of the splitting assemblies 10, 12 are located so that they engage portions of the resulting block(s) that correspond to the top and bottom, left and right front corners thereof. (When referring to the resulting blocks, the terms "top", "bottom", "upper", and "lower" refer to the blocks as they will be laid in a wall.) This is evident from FIGS. 1 and 3 which illustrate the projections 36 positioned adjacent each end of the holder 23, and from FIGS. 5 and 6 which illustrate the projections 38, 40 positioned adjacent each end of the holder 28.

Breaking of the top and bottom edges of the blocks between the front corners results primarily through engagement with the surfaces 26*a,* 26*b,* 34*a,* 34*b* between the projections 36, 38, 40.

As discussed above, contact between the splitting assemblies 10, 12 and the workpiece 14 may cause the to-be-formed blocks to have a tendency to move during splitting, thereby reducing the intended effectiveness of the projections 36, 38, 40. To inhibit movement, one or more biasing forces are applied to the workpiece 14 to bias the workpiece downward toward the support table 18 during splitting. The biasing force(s) that is applied is preferably sufficient to prevent movement of the to-be-formed blocks during splitting.

In the illustrated embodiment, the top splitting assembly 10 is designed to apply biasing forces to the top surface 22 of the workpiece 14 during splitting to bias the workpiece downward against the support table 18. In particular, with reference to FIGS. 1–4, the splitting assembly 10 is provided with first and second biasing mechanisms 44*a,* 44*b* which apply first and second biasing forces, respectively, to the top surface 22 of the workpiece.

As shown in FIGS. 1–4, the biasing mechanisms 44*a,* 44*b* comprise extension members 46*a,* 46*b* that are fixed to opposite sides of the blade holder 23 and extend over the top surface 22 of the workpiece. The extension members 46*a,* 46*b* are preferably detachably fixed to the blade holder 23, for example by being bolted thereto. Detachable connection permits the bias mechanisms 44*a,* 44*b* to be removed from the splitting assembly 10 if the hold-down function thereof is not necessary for the particular splitting process, or if the mechanisms 44*a,* 44*b* become damaged and need replacement or repair.

With reference to FIG. 4, each extension member 46*a,* 46*b* includes a plate portion 48, an inner flange portion 50 through which the extension members are fixed to the blade holder 23, and an outer flange portion 52. The flange portions 50, 52 are generally similar in construction which allows each extension member 46*a,* 46*b* to be rotated 180 degrees to permit the extension member to be fixed to the blade holder via the flange portion 52, as well as permitting the extension members 46*a,* 46*b* to be fixed to either side of the blade holder 23.

Each biasing mechanism 44*a,* 44*b* also includes a hold-down apparatus 54*a,* 54*b,* respectively. As shown in FIGS. 1–2, each apparatus 54*a,* 54*b* is configured to contact the top surface 22 of the workpiece 14 to apply the biasing forces thereto. The hold-down apparatus 54*a* is illustrated in the figures as being different in construction from the hold-down apparatus 54*b* to show different possible hold-down constructions. However, the hold-down apparatus of the biasing mechanism 44*a* could have, and in the preferred embodiment would likely have, the same configuration as the hold-down apparatus of the biasing mechanism 44*b*.

Figure 3:
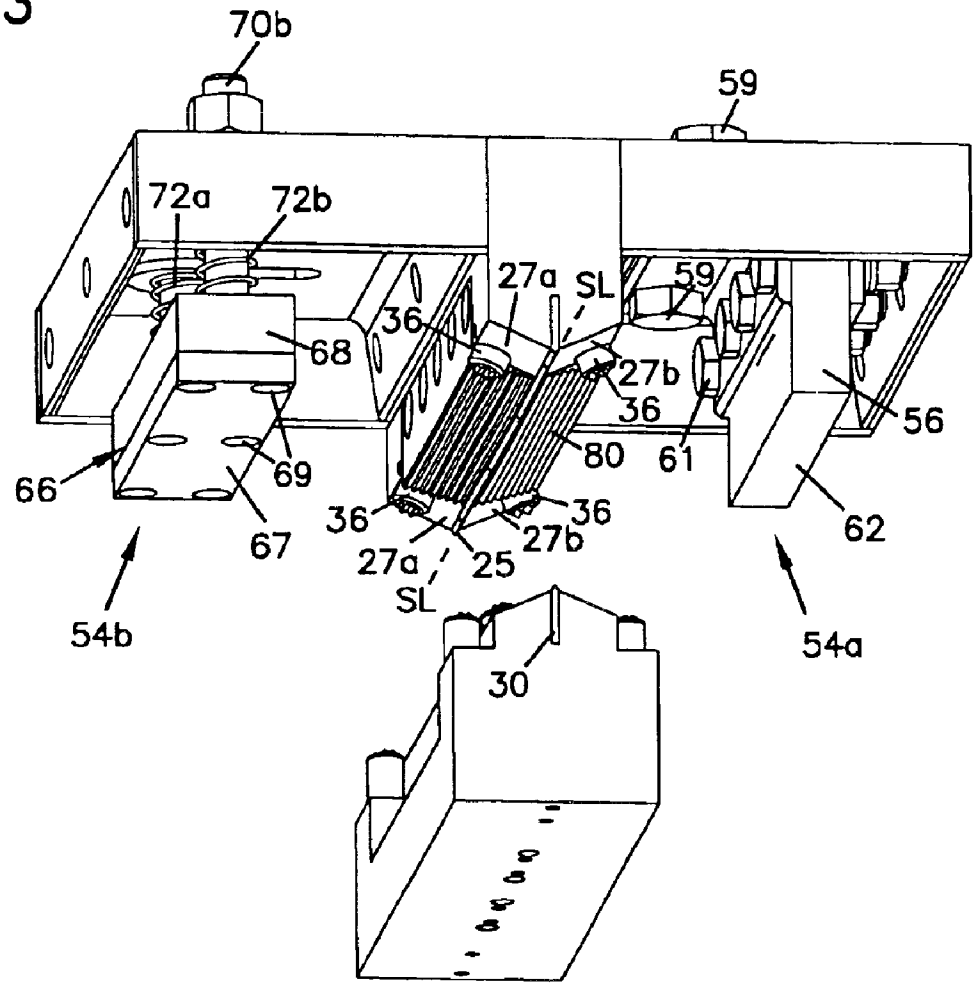
FIG. 3 is a perspective view of the top and bottom splitting assemblies looking upward toward the top splitting assembly.
Figure 4:
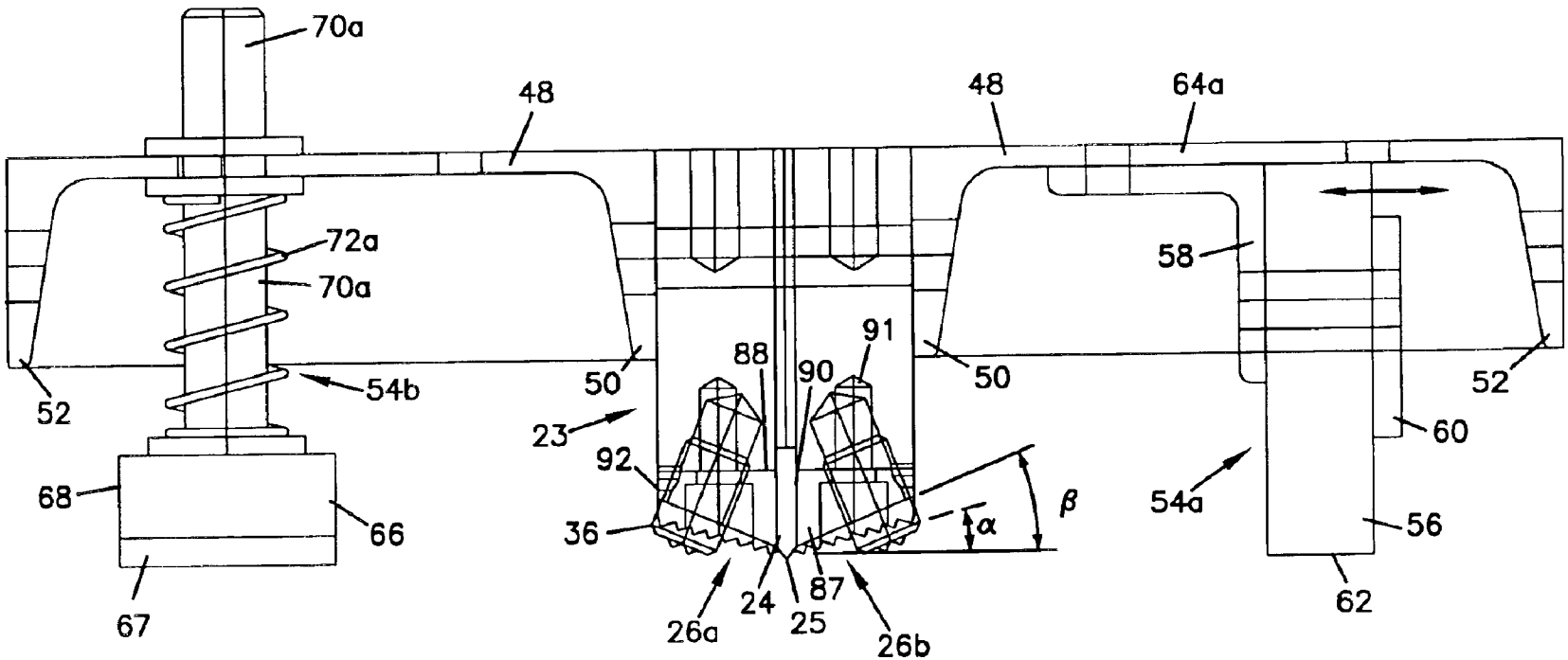
FIG. 4 is a cross-sectional view of the top splitting assembly of the invention using an alternative embodiment of a multiplicity of peaks.

Returning to FIG. 4, the hold-down apparatus 54*a* comprises an elastomeric plate 56 that is fixed to the plate portion 48 via a bracket 58 and at least one, preferably a plurality of, bolts 59 (the bolts are visible in FIG. 3). The plate 56 is fixed to the bracket 58 via at least one, preferably a plurality of, bolts 61 (the bolts are visible in FIG. 3) or other suitable fasteners to enable removal of the plate 56 when it becomes damaged or worn. A plate 60 is fixed to the side of the plate 56 opposite the bracket 58 to provide stiffness to the upper end of the plate 56.

The plate 56 is preferably made of an elastomeric material such as rubber. The plate 56 includes a free end 62 that is intended to contact the upper surface 22 of the workpiece during splitting to apply a biasing force. The free end 62 extends slightly below the tip of the splitting edge 25 and below the tips of the projections 36, whereby the plate 56 contacts the upper surface 22 prior to the splitting assembly 10 contacting the workpiece 14. As a result, the biasing force is applied to the workpiece 14 before splitting starts. The length of the plate 56 is selected such that it extends across the majority of the width of the upper surface 22, as shown in FIG. 1. The plate 56 could have other lengths as long as the biasing force applied thereby to the workpiece 14 is sufficient to achieve the intended hold-down function.

When plate 56 contacts the upper surface 22 of the workpiece, the elastomeric plate 56 compresses and flexes to permit continued downward movement of the splitting assembly 10 to achieve splitting. After splitting, when the splitting assembly 10 returns to its home position, the plate 56 returns substantially to its original shape.

The plate 56 is also preferably adjustable toward and away from the blade holder 23 to permit adjustments to the location of the biasing force that is applied to the workpiece 14. With reference to FIGS. 1, 3 and 4, it is seen that the plate portion 48 includes a pair of slots 64*a,* 64*b* formed therethrough. The bolts 59 that fix the bracket 58 to the plate portion 48 extend upwardly through the slots 64*a,* 64*b*. By loosening the bolts 59, the hold-down apparatus 54*a* can be adjusted toward or away from the blade holder 23 to alter the location of application of the biasing force on the workpiece. The hold-down apparatus 54*a* is then locked at the desired location by once again tightening the bolts 59.

A suitable biasing force provided by the plate 56 is between about 80 to about 200 ft. lbs. The biasing force would vary based on the durometer of the elastomeric material of the plate 56, with an increase in the durometer resulting in an increase in the biasing force that is applied to the workpiece.

Returning to FIG. 4, the hold-down apparatus 54*b* comprises a metal bar 66 that has a length substantially equal to the length of the plate 56. The bar 66 comprises a replaceable wear section 67 that is removably secured to a support plate 68 using fasteners, for example screws (not shown), that are received in apertures 69 in the wear section 67. The section 67, which can wear or be damaged as a result of contact with the top surface of the workpiece, can thus be replaced as necessary.

The bar 66 is secured to the plate portion 48 via a pair of bolts 70*a,* 70*b* that extend upwardly from the plate 68 and through the plate portion 48. Coil springs 72*a,* 72*b* disposed around each bolt 70*a,* 70*b* bias the bar 66 downward, but permit the bar 66 to move upward toward the plate portion 48 when the bar engages the workpiece during splitting. Thus, the bar 66 has some resiliency and "give" as it engages the workpiece to apply the biasing force. This prevents the bar 66 from damaging the upper surface of the workpiece during splitting. After splitting, when the splitting assembly 10 returns to its home position, the bar 66 is returned to its original position by the coil springs 72*a,* 72*b*.

As with the hold-down apparatus 54*a,* the hold-down apparatus 54*b* is preferably adjustable toward and away from the blade holder 23 to permit adjustments to the location of the bias force applied to the workpiece 14. As shown in FIG. 1, slots 73*a,* 73*b* formed in the plate portion 48, which are similar to the slots 64*a,* 64*b* for the hold-down apparatus 54*a,* permit the adjustment when the nuts on the bolts 70*a,* 70*b* are loosened.

It is noted that the adjustment of the hold-down apparatus 54*a* is independent of the adjustment of the hold-down apparatus 54*b*. This permits the locations of the biasing forces to be separately adjustable so that the locations of the biasing forces on each side of the splitting line can be selectively chosen to achieve the best splitting results.

EXAMPLE

The following example is illustrative, but not limiting, of the invention.

A workpiece that results in the production of two Windsor blocks from Anchor Wall Systems, Inc. was provided. Each Windsor block weighs about 24 pounds (i.e. the workpiece weighs about 48 pounds). The workpiece had a height of about 4 inches between the surfaces 20, 22 and a length from one end to the other end of about 16 inches (i.e. each block is approximately 8 inches between the front surface and the rear surface). Two hold-down apparatus similar to the apparatus 54*a* with projections that are about 0.625 inches in diameter were used, with each hold-down apparatus being positioned to apply a biasing force of between about 80 to about 200 ft. lbs. at a distance D of about 5.5 inches from the splitting edge 25 to the center of the plate 56 (see FIG. 2). Satisfactory results were achieved when the workpiece was split.

Depending upon the size and mass of the workpiece, the biasing forces could be applied at other distances from the splitting edge could be used. In addition, the biasing forces need not be applied at the same distance from the splitting edge, and/or the biasing forces that are applied need not have the same value, particularly if the workpiece that is being split is not symmetrical on each side of the cleaving line.

As noted above, the hold-down apparatus on each side of the blade holder 23 will likely be the same, so that either two of the hold-down apparatus 54*a* or two of the hold-down apparatus 54*b* will be used. Regardless of which two hold-down apparatus are used, the application of the hold-down forces to the workpiece 14 by the hold-down apparatus helps to hold the workpiece down on the support table 18 during splitting to prevent movement of the to-be-formed blocks. As a result, the action of the projections 36, 38, 40 on the workpiece, and the resulting appearance of the blocks, is enhanced.

With reference to FIGS. 2–6, the appearance of the resulting blocks can also be enhanced by modifying the engagement surfaces 26*a*, 26*b*, 34*a*, 34*b* between the projections 36, 38 so that the engagement surfaces 26*a*, 26*b*, 34*a*, 34*b* chip and roughen portions of the upper and lower surfaces of the blocks near the front faces. Roughening the upper and lower surfaces in this manner helps make the blocks appear more natural, and minimizes the appearance of a ledge when the blocks are stacked into set-back courses. The surface modifications should be such as to result in additional concrete material being chipped away on the upper and lower surfaces of the blocks near the front faces when the engagement surfaces 26*a*, 26*b*, 34*a*, 34*b* contact the workpiece.

The surface modifications preferably comprise a multiplicity of peaks formed on the engagement surfaces 26*a*, 26*b*, 34*a*, 34*b* between the projections 36, 38. In the preferred embodiment, the peaks are in the form of a plurality of ridges 80 extending parallel to the splitting edges 25, 32 of the blades 24, 30, with valleys or grooves defined between adjacent ridges. The alternating ridges 80 and valleys provide the engagement surfaces 26*a*, 26*b*, 34*a*, 34*b* with a generally serrated or saw-toothed appearance when viewed from the end. The ridges 80 are preferably angled in a direction toward the workpiece 14, and preferably have sharp tips. Alternatively, the ridges 80 can have radiused tips, although the resulting distressing action will generally be less than that achieved using sharp tips. The ridges 80 and valleys can be used alone, or in combination with the projections 36, 38, 40.

The ridges 80 preferably extend from adjacent the blades 24, 30 across the entire width of the engagement surfaces 26*a*, 26*b*, 34*a*, 34*b*, and for each splitting assembly 10, 12, preferably extend along substantially the entire length of the engagement surfaces 26*a*, 26*b*, 34*a*, 34*b* between the projections 36, 38. Depending upon the result one wishes to achieve on the resulting blocks, the ridges 80 can extend along only portions of the engagement surfaces 26*a*, 26*b*, 34*a*, 34*b* between the projections 36, 38. In addition, depending upon how much of the upper surface of the block is to be chipped and roughened, the ridges 80 can extend across portions of the width of the engagement surfaces 26*a*, 26*b*, 34*a*, 34*b* rather than their entire width.

Similar peaks are disclosed in U.S. patent application Ser. No. 10/103,155. One way in which the multiplicity of peaks of the present invention differ from the multiplicity of peaks in U.S. patent application Ser. No. 10/103,155 is that the multiplicity of peaks described herein are more readily removable and replaceable with a different set of peaks to permit adjustment in the chipping and roughening action of the peaks. Thus, by replacing the peaks with another set of peaks having a different configuration, the resulting appearance of the blocks can be changed.

In the embodiment illustrated in FIGS. 2–3 and 5–6, the ridges 80 on the bottom splitting assembly 12 are formed on plates 82 that are detachably secured to the blade holder 28 on each side of the blade 30 to form the continuous ridges and valleys of the engagement surfaces 34*a*, 34*b*. The plates 82 on the top splitting assembly are preferably identical in construction to the plates of the bottom splitting assembly, as illustrated in FIG. 3, although the plates 82 on the top splitting assembly 10 could have a configuration different than the plates 82 on the lower splitting assembly 10 if different chipping and roughening actions are desired.

Figure 6:
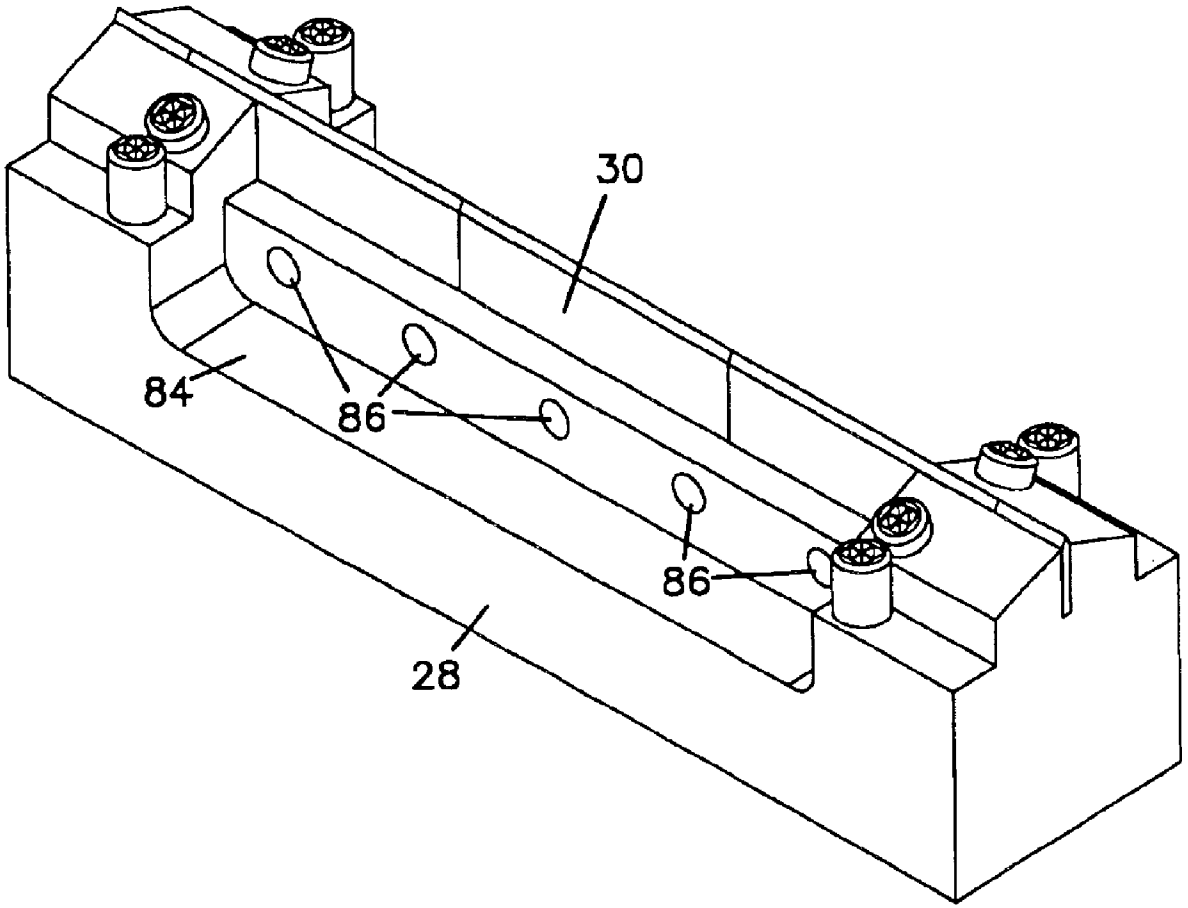
FIG. 6 is a perspective view of the bottom splitting assembly with the multiplicity of peaks removed.

The plates 82 comprise a portion 83*a* that includes the ridges 80, and a mounting flange portion 83*b*. As shown in FIG. 6 for the blade holder 28, a cut-out section 84 is formed in the blade holder 28 on each side of the blade 30 between the projections 38. The plates 82 on the blade holder 28 are fixed in place using suitable fasteners, such as bolts (not shown), that extend through apertures 85 in both of the flange portions 83*b* on each side of the blade holder 28 and through corresponding apertures 86 in the blade holder 28. For the top splitting assembly 10, if plates 82 are used, they are mounted to the blade holder 23 in a similar manner.

Figure 5:
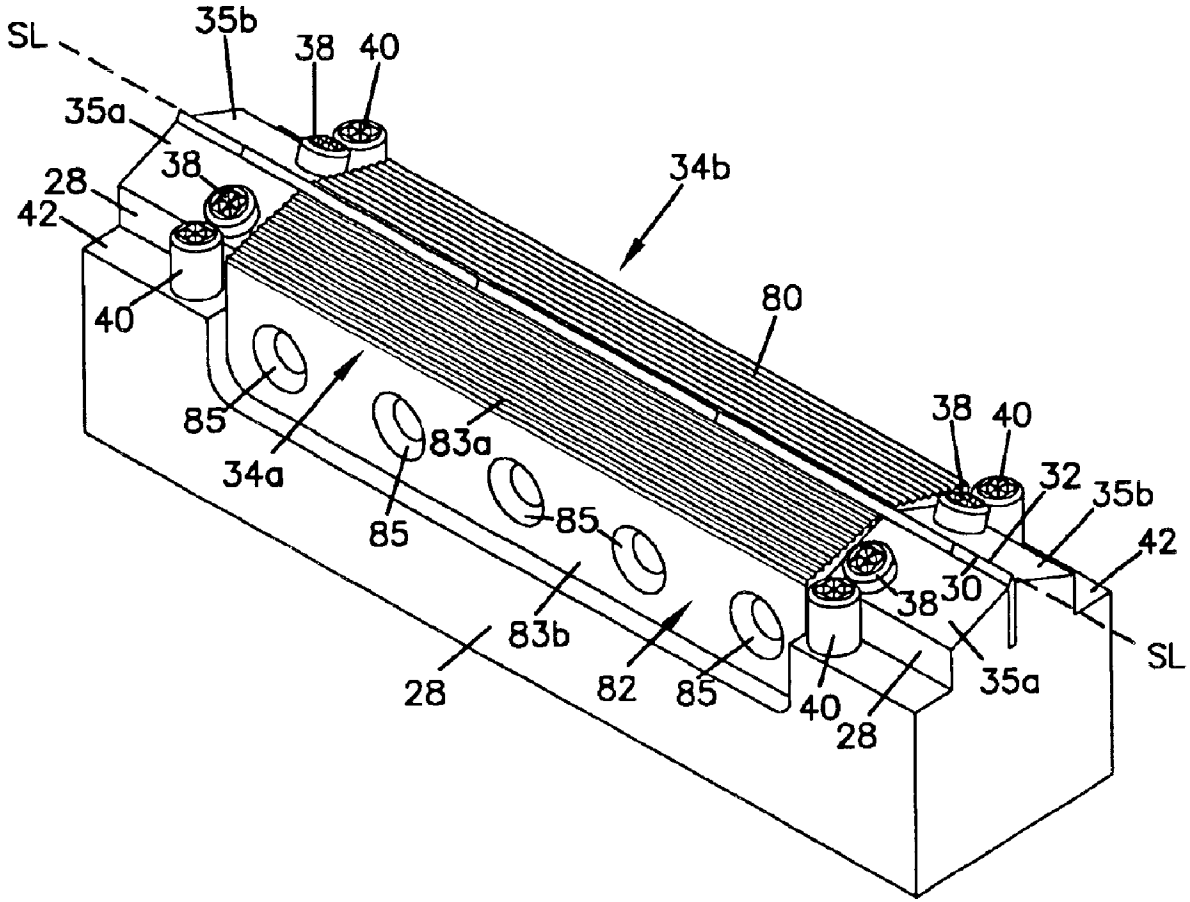
FIG. 5 is a perspective view of the bottom splitting assembly with the multiplicity of peaks in place.

The construction of the plates 82 permits an increase in the amount of ridges 80 that can be provided on the engagement surfaces. As illustrated in FIG. 5, the portion 83*a* of the plate 82 is wider than the surfaces 35*a*, 35*b* containing the projections 38 so that the ridges extend between the projections 40. In FIG. 5, the width of the portion 83*a* is the distance between the side of the blade 30 and the outer vertical surface of the flange portion 83*b*, and the width of the surfaces 35*a*, 35*b* is the distance between the side of the blade 30 and the vertical surfaces 94 of the blade holder 28. As a result, more of the upper surfaces of the resulting blocks adjacent the front faces are chipped and roughened compared to when the ridges are provided on a surface having a width equal to the surfaces 35*a*, 35*b*.

The plates 82 can be made from A2 tool steel, although the plates could be made from other suitable materials, such as carbide, as well.

An alternative form of the ridges 80 for the top splitting assembly 10 is illustrated in FIG. 4. In the embodiment, the ridges 80 are formed on bars 87 that are secured within suitably formed cut-outs on the blade holder 23. Each bar 87 includes a planar bottom side 88 that rests on a corresponding planar portion of the cut-outs of the blade holder 23, an interior planar, substantially vertical side 90 that abuts against the surface of the blade 24, an exterior planar, substantially vertical side 92, and a top side that contains the ridges 80. The bars 87 are secured to the blade holder 23 using fasteners such as screws 91.

As an alternative to ridges 80, the peaks could comprise a plurality of pyramids arranged in a checkerboard pattern on the engagement surfaces 26*a*, 26*b*, 34*a*, 34*b* similar to the top surfaces of the projections 36, 38.

The plates 82 and bars 87 are wear locations during the splitting process. Therefore, the detachable mounting of the plates 82 and bars 87 permits replacement as necessary. Moreover, the plates and bars can be removed and replaced with a new set of plates and bars having a different configuration, in order to alter the chipping and roughening action on the blocks.

With the plates 82 and bars 87 in place, the highest points of the plates 82 and bars 87 can either be below or above the splitting edges 25, 32 of the blades 24, 30. Preferably, the highest points of the bars are between about 0.125 inches below and about 0.125 inches above the splitting edges.

Figure 7:
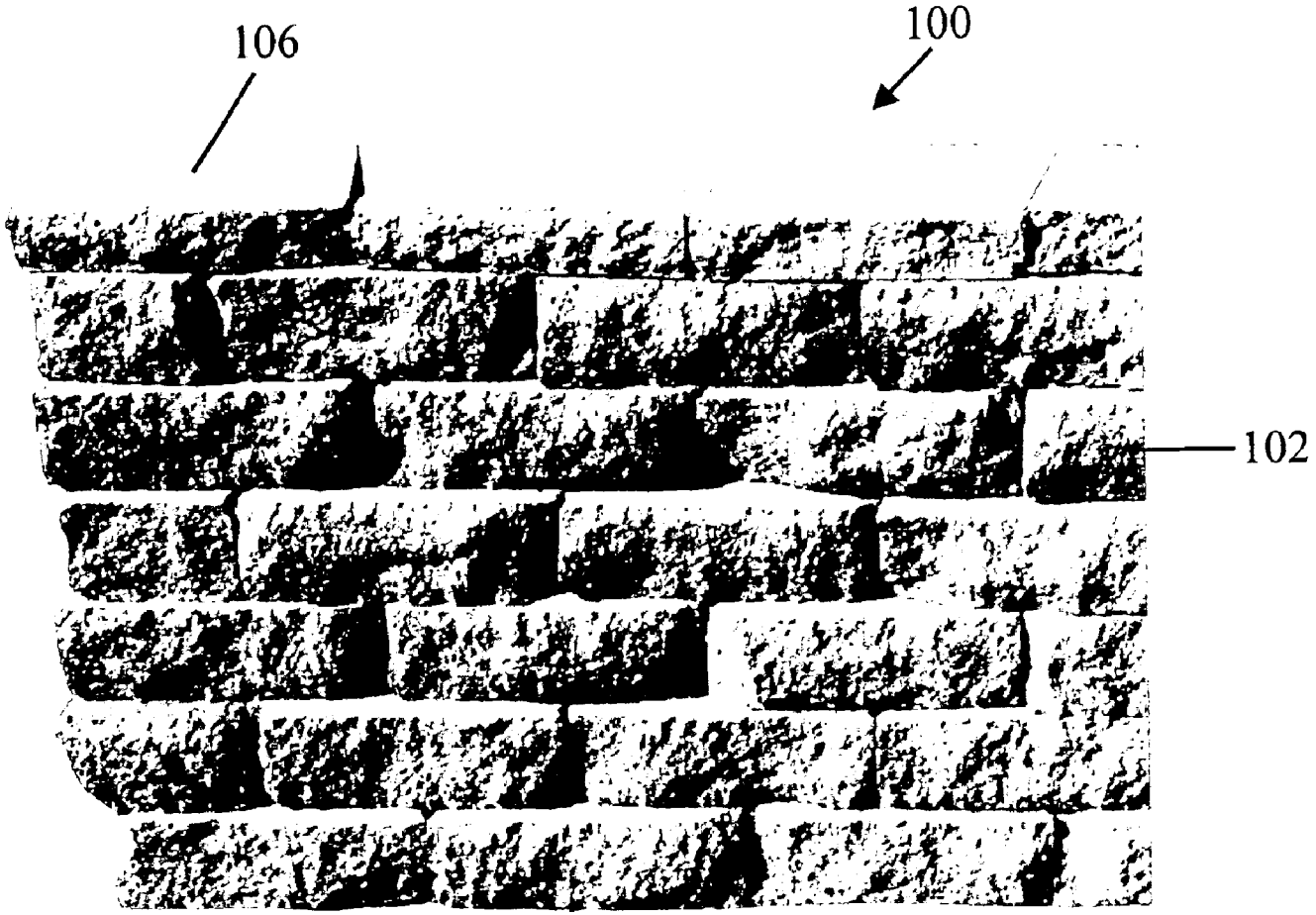
FIG. 7 is a print out of a photograph showing a portion of a wall constructed from a plurality of blocks that have been produced using the equipment and methods according to the present invention.

A portion of a wall 100 that is constructed from a plurality of blocks 102 resulting from splitting the workpiece 14 using the top and bottom splitting assemblies 10, 12 in FIGS. 1–6 is illustrated in FIG. 7. Each block 102 includes a block body with a generally planar top surface, a generally planar bottom surface, a pair of side surfaces, a front surface, and a rear surface.

Each block 102 also includes a locator and shear protrusion in the form of a lip or flange 104 formed integrally on the bottom surface adjacent to, and preferably forming a portion of, the rear surface. The lip 104 is best seen in FIG. 2, which illustrates a lip 104 formed at each end of the workpiece 14. The lip 104 establishes a uniform set back for the wall 100 formed from the blocks 102, and provides some resistance to shear forces. In the preferred configuration, the lip 104 is continuous from one side of the block 102 to the other side. However, the lip 104 need not be continuous from one side to the other side, nor does the lip 104 need to be contiguous with the rear surface. A different form of protrusion that functions equivalently to the lip 104 for locating the blocks could be used.

In the blocks 102, the top and bottom surfaces do not have to be planar, but they do have to be configured so that, when laid up in courses, the block tops and bottoms in adjacent courses stay generally parallel to each other. Further, the front surface of each block is wider than the rear surface, which is achieved by angling at least one of the side surfaces, preferably both side surfaces, so that the side surfaces get closer together (converge) as they approach the rear surface. Such a construction permits serpentine walls to be constructed. It is also contemplated that the side surfaces can start converging from a position spaced rearwardly from the front surface. This permits adjacent blocks to abut slightly behind the front face along regular surfaces that have not been altered by the action of the splitting assemblies, engagement surfaces, or projections, which in turn, means that it is less likely that fine materials behind the wall can seep out through the face of the wall.

As seen in FIG. 7, the front surface of each block has an irregular, rock-like texture. In addition, an upper edge and a lower edge of the front surface are also irregular as a result of the splitting assemblies 10, 12.

In addition, the ridges 80 on the engagement surfaces of the splitting assembly 12 chip and roughen a portion of the top surface of the block adjacent the upper edge and front face of the block. Since each course of blocks is setback from the course below, a portion of the top surface of each block 102 in the lower course is visible between the front surface of each block 102 in the lower course and the front surface of each block in the adjacent upper course. In the absence of the treatment described herein, the entire top surface portion is regular and planar which creates the appearance of a ledge between each course. However, as a result of the action of the ridges 80, the chipped and roughened portions of the visible portions are irregular and non-planar, thereby minimizing the appearance of the ledge and making the wall 100 and the blocks 102 from which it is formed appear more natural. In addition, the upper edge of the block 102 is also slightly rounded as a result of the ridges 80 and grooves.

FIG. 7 also illustrates cap blocks 10 disposed on the top course of blocks 102. The cap blocks 106 present a cap course that is of a lesser height than the other courses, and cover the gaps between the blocks 102 in the top course.

There may be instances when it is satisfactory that a block be provided with only one irregular edge on the front face and with only a chipped and roughened top surface portion. Therefore, it is contemplated and within the scope of the invention that a workpiece could be split using a single one of the splitting assemblies described herein, preferably the bottom splitting assembly.

Further, a splitting assembly could have engagement surface enhancements on only one side of the splitting line, and have projections that are disposed on only one side of the splitting line. Still further, a splitting assembly could use engagement surface enhancements without using projections.

It is further contemplated and within the scope of the invention that a workpiece could be split into a single block and one or more waste pieces. In this case, the engagement surface enhancements and the projections (if used) on the bottom and top splitting assemblies would be disposed on the same side of the splitting line for each splitting assembly.

Moreover, it is contemplated and within the scope of the invention that the splitting assemblies could be used without the blades 24, 30.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method of producing a concrete block having an irregular front surface and at least one irregular edge along the front surface from a concrete workpiece, comprising:

a) providing a concrete block splitting machine that includes a workpiece support and a first splitting assembly having:

i) a first block splitter, the first block splitter being positioned to apply a splitting force to the workpiece to split the workpiece during an activation of the first splitting assembly to result in the concrete block with the irregular front surface;

ii) a first engagement surface extending away from the first block splitter across an adjacent portion of a first surface of the workpiece; and, iii) a plurality of projections on the first engagement surface positioned so that they engage the first surface of the workpiece adjacent the front surface of the resulting concrete block during the splitting operation to break away portions of the concrete adjacent the front surface of the resulting concrete block and produce the irregular edge;

b) locating a concrete workpiece in the concrete block splitting machine so that the workpiece is supported on the workpiece support in position for splitting;

c) applying at least one biasing force to the workpiece to bias the workpiece downward against the workpiece support; and d) activating the first splitting assembly so that the first block splitter splits the workpiece and the projections engage the first surface of the workpiece adjacent the front surface of the resulting concrete block and produce the irregular edge while the biasing force is being applied to the workpiece.

2. The method of claim 1, further including providing a second splitting assembly opposed to the first splitting assembly, the second splitting assembly including a second block splitter positioned to apply a splitting force to the workpiece to split the workpiece during an activation of the second splitting assembly and having a second engagement surface extending away from the second block splitter across an adjacent portion of a second surface of the workpiece, and a plurality of projections on the second engagement surface positioned so that they engage the second surface of the workpiece adjacent the front surface of the resulting concrete block during the splitting operation to break away portions of the concrete adjacent the front surface of the resulting concrete block and produce a second irregular edge; and activating the first and second opposed splitting assemblies so that the first and second block splitters converge on and strike the workpiece to split the workpiece and the first and second plurality of projections engage the respective workpiece surfaces adjacent the front surface of the resulting concrete block during the splitting operation to produce the first and second irregular edges.

3. The method of claim 2, wherein the workpiece includes a top surface and a bottom surface, and wherein the first splitting assembly is positioned to engage the bottom surface and the second splitting assembly is positioned to engage the top surface, and wherein the biasing force is applied to a portion of the top surface.

4. The method of claim 2, wherein each of said first and second block splitters comprises a splitting blade.

5. The method of claim 4, wherein each said blade has a straight splitting edge.

6. The method of claim 2, wherein each of the first and second splitting assemblies includes a plurality of projections disposed on each side of the first and second block splitters.

7. The method of claim 3, further comprising applying a plurality of biasing forces to the top surface of the workpiece, the biasing forces being applied at positions spaced from each other on each side of the front surface of the resulting concrete block.

8. The method of claim 3, wherein the biasing force is applied using a resilient member.

9. The method of claim 7, wherein the biasing forces are applied using at least two resilient members.

10. The method of claim 8, wherein said resilient member comprises a rubber plate.

11. The method of claim 9, wherein each said resilient member comprises a rubber plate.

12. The method of claim 7, wherein the biasing forces are applied in a direction generally perpendicular to the top and bottom surfaces.

13. The method of claim 7, wherein, during activation, each of the first and second splitting assemblies is moveable into engagement with the workpiece, and the biasing forces are applied in a direction generally parallel to the direction of movement of the first and second splitting assemblies.

14. The method of claim 7, wherein the biasing forces are generally parallel to each other.

15. The method of claim 2, wherein the first and second splitting assemblies are actuated so that the second splitting assembly contacts the workpiece before the first splitting assembly.

16. The method of claim 9, wherein the resilient members are fixed to and move together with the second splitting assembly.

17. A method of producing a concrete block having an irregular front surface and at least one irregular edge along the front surface from a concrete workpiece, comprising:

providing a concrete block splitting machine having a workpiece support and a first splitting assembly that includes a first block splitter positioned to apply a splitting force to the workpiece to split the workpiece during an activation of the first splitting assembly to result in the concrete block with the irregular front surface, and a first plurality of projections disposed adjacent to at least one side of the first block splitter and positioned so that they engage the workpiece adjacent the front surface of the resulting concrete block during the splitting operation to break away portions of the concrete adjacent the front surface of the resulting concrete block and produce the irregular edge;

locating a concrete workpiece in the concrete block splitting machine on the workpiece support in a position to be split; and applying at least one biasing force to the workpiece to bias the workpiece downward against the workpiece support, and activating the first splitting assembly to split the workpiece while the biasing force is being applied to the workpiece.

18. The method of claim 17, further including providing a second splitting assembly opposed to the first splitting assembly, the second splitting assembly including a second block splitter positioned to apply a splitting force to the workpiece to split the workpiece during an activation of the second splitting assembly and having a second plurality of projections disposed adjacent to at least one side of the second block splitter and positioned so that they engage the workpiece adjacent the front surface of the resulting concrete block during the splitting operation to break away portions of the concrete adjacent the front surface of the resulting concrete block and produce a second irregular edge; and activating the first and second opposed splitting assemblies so that the first and second block splitters converge on and strike the workpiece to split the workpiece and the first and second plurality of projections engage the workpiece adjacent the front surface of the resulting concrete block during the splitting operation to produce the first and second irregular edges.

19. The method of claim 18, wherein the workpiece includes a top surface and a bottom surface, and wherein the first splitting assembly is positioned to engage the bottom surface and the second splitting assembly is positioned to engage the top surface, and wherein the biasing force is applied to a portion of the top surface.

20. The method of claim 18, wherein said first and second block splitters of said first and second splitting assemblies each comprises a splitting blade.

21. The method of claim 20, wherein each said splitting blade has a straight splitting edge.

22. The method of claim 18, wherein each of the first and second splitting assemblies includes a plurality of projections disposed on each side of said first and second block splitters.

23. The method of claim 19, further comprising applying a plurality of biasing forces to the top surface of the workpiece, the biasing forces being applied at positions spaced from each other on each side of the front surface of the resulting concrete block.

24. The method of claim 19, wherein the biasing force is applied using a resilient member.

25. The method of claim 23, wherein the biasing forces are applied using at least two resilient members.

26. The method of claim 24, wherein said resilient member comprises a rubber plate.

27. The method of claim 25, wherein each said resilient member comprises a rubber plate.

28. The method of claim 23, wherein the biasing forces are applied in a direction generally perpendicular to the top and bottom surfaces.

29. The method of claim 23, wherein during activation, each of the first and second splitting assemblies is moveable into engagement with the workpiece, and the biasing forces are applied in a direction generally parallel to the direction of movement of the first and second splitting assemblies.

30. The method of claim 23, wherein the biasing forces are generally parallel to each other.

31. The method of claim 18, wherein the first and second splitting assemblies are actuated so that the second splitting assembly contacts the workpiece before the first splitting assembly.

32. The method of claim 25, wherein the resilient members are fixed to and move together with the second splitting assembly.

33. A block splitting machine for splitting a concrete workpiece to result in a concrete block with an irregular front surface and at least one irregular edge along the front surface, comprising:

a workpiece support;

a first splitting assembly including a first block splitter that is positioned to apply a splitting force to the workpiece when the workpiece is supported on the workpiece support to split the workpiece during an activation of the first splitting assembly to result in the concrete block with the irregular front surface, the first splitting assembly further including a first plurality of projections adjacent at least one side of the first block splitter and positioned so that they engage the workpiece adjacent the front surface of the resulting concrete block during activation of the first splitting assembly to break away portions of the concrete adjacent the front surface of the resulting concrete block and produce the irregular edge; and a first mechanism for applying a biasing force to the workpiece to bias the workpiece downward against the workpiece support during activation of the first splitting assembly.

34. The block splitting machine of claim 33, further including a second splitting assembly opposed to the first splitting assembly, the second splitting assembly including a second block splitter positioned to apply a splitting force to the workpiece to split the workpiece during an activation of the second splitting assembly and including a second plurality of projections disposed adjacent to at least one side of the second block splitter on the same side of the front surface of the resulting concrete block as the first plurality of projections of the first splitting assembly and positioned so that they engage the workpiece adjacent the front surface of the resulting concrete block during a splitting operation to break away portions of the concrete adjacent the front surface of the resulting concrete block and produce a second irregular edge.

35. The block splitting machine of claim 34, wherein each of said first and second block splitters comprises a splitting blade.

36. The block splitting machine of claim 35, wherein each said splitting blade has a straight splitting edge.

37. The block splitting machine of claim 35, wherein the projections of each of said first and second splitting assemblies are disposed on each side of the respective splitting blade.

38. The block splitting machine of claim 34, wherein the first mechanism is arranged and configured to apply the biasing force to a top surface of the workpiece on one side of, and spaced from, the front surface of the resulting concrete block.

39. The block splitting machine of claim 38, further comprising a second mechanism for applying a biasing force to the workpiece during splitting.

40. The block splitting machine of claim 39, wherein the second mechanism is arranged and configured to apply the biasing force to the top surface of the workpiece spaced from the front surface of the resulting concrete block and on the opposite side of the front surface from the biasing force applied by the first mechanism.

41. The block splitting machine of claim 39, wherein each of the first and second mechanisms are fixed to and move together with either the first or second splitting assembly.

42. The block splitting machine of claim 39, wherein at least one of the first and second mechanisms comprises a resilient member.

43. The block splitting machine of claim 42, wherein the resilient member comprises a rubber plate.

44. The block splitting machine of claim 43, wherein each of the first and second mechanisms comprises a rubber plate.

45. The block splitting machine of claim 41, wherein the block splitter of the splitting assembly to which the first and second mechanisms are fixed includes a splitting edge, and each of the first and second mechanisms includes a free edge that projects past the splitting edge.

46. The block splitting machine of claim 40, wherein each of the first and second mechanisms are configured to permit adjustment of the location of the respective biasing forces applied to the top surface of the workpiece.

47. The block splitting machine of claim 46, wherein the location of the biasing force applied by the first mechanism is adjustable separately from the location of the biasing force applied by the second mechanism.

48. The block splitting machine of claim 40, wherein the magnitude of the biasing force applied by the first mechanism is substantially the same as the magnitude of the biasing force applied by the second mechanism.

49. The block splitting machine of claim 40, wherein the biasing forces of the first and second mechanisms are applied to the top surface of the workpiece the same distance from the front surface of the resulting concrete block.

50. The block splitting machine of claim 33, wherein the first splitting assembly comprises a block splitter holder upon which the first plurality of projections are mounted, and the block splitter holder comprises a multiplicity of peaks that engage the workpiece during activation of the first splitting assembly.

51. The block splitting machine of claim 50, wherein the multiplicity of peaks are detachably connected to the block splitter holder.

52. The block splitting machine of claim 50, wherein the block splitter holder includes surfaces upon which the projections are mounted, the surfaces extend from adjacent the first block splitter and are disposed at a first acute angle relative to horizontal.

53. The block splitting machine of claim 52, wherein the block splitter holder further includes engagement surfaces upon which the multiplicity of peaks are disposed, the engagement surface extend from adjacent the first block splitter and are disposed at a second acute angle relative to horizontal.

54. The block splitting machine of claim 53, wherein the second acute angle is larger than the first acute angle.

55. The block splitting machine of claim 53, wherein the first acute angle is between about 5 degrees and about 15 degrees, and the second acute angle is about 22 degrees.

56. The block splitting machine of claim 53, wherein the width of the engagement surfaces containing the multiplicity of peaks is greater than the width of the surfaces containing the projections.

* * * * *